US006371292B1

(12) United States Patent
McCown et al.

(10) Patent No.: US 6,371,292 B1
(45) Date of Patent: Apr. 16, 2002

(54) PROTECTIVE COVER FOR STACKED LUMBER

(75) Inventors: David Michael McCown, Arlington; George M. Hall, Colleyville, both of TX (US)

(73) Assignee: Olympic General Corporation, Reno, NV (US)

( * ) Notice: Subject to any disclaimer, the term of this patent is extended or adjusted under 35 U.S.C. 154(b) by 0 days.

(21) Appl. No.: 09/594,225

(22) Filed: Jun. 14, 2000

(51) Int. Cl.[7] ..... B65D 85/46
(52) U.S. Cl. ..... 206/321; 206/497; 383/66
(58) Field of Search ..... 383/37, 66, 67; 206/321, 497

(56) References Cited

U.S. PATENT DOCUMENTS 3,387,641 A * 6/1968 Osborne
3,834,528 A * 9/1974 Pickford et al.
3,987,959 A * 10/1976 Deards et al.
4,871,046 A * 10/1989 Turner
5,110,005 A * 5/1992 Schilling
5,219,219 A * 6/1993 Virdin, Jr.
5,676,467 A * 10/1997 Gebhardt ..... 383/66

* cited by examiner

*Primary Examiner*—David T. Fidei
(74) *Attorney, Agent, or Firm*—Michael A. O'Neil

(57) ABSTRACT

A protective covering for a lumber stack is constructed by providing an appropriately sized sheet of heavy duty heat shrinkable plastic material, folding the side edges of the plastic sheeting material inwardly along spaced apart longitudinally extending lines to form top and bottom layers and joining the ends of the top and bottom layers to define a top layer which is imperforate throughout its entire length and width and a bottom layer which is imperforate throughout its entire length and width except for a lumber stack receiving slit extending along the longitudinal center line of the bottom wall from end to the other.

10 Claims, 5 Drawing Sheets

PROTECTIVE COVER FOR STACKED LUMBER

TECHNICAL FIELD

This invention relates generally to the protection of stacked lumber from damage due to weather, etc., during shipment, and more particularly to a method of and apparatus for protecting stacked lumber which incorporate numerous advantages over the prior art.

BACKGROUND AND SUMMARY OF THE INVENTION

2×4's, 2×6's, 2×8's, plywood, and similar lumber products are typically arranged in stacks for shipment from the manufacturer to lumber yards, hardware stores, contractors, etc. Stacks of lumber are typically wrapped in plastic sheeting during transport. The plastic wrapping protects the lumber from exposure to the elements and also provides a convenient place to identify the manufacturer of the lumber.

In a typical application, plastic sheeting covers all four sides and the top, but not the bottom, of a lumber stack. Heretofore two methods have been used to wrap lumber stacks with plastic sheeting. One method is to wrap a lumber stack with an appropriately sized plastic sheet in the same manner that a rectangular package is wrapped for shipping or as a gift. Another method is to use an envelope-like construction comprising a plastic sheet with is folded in half longitudinally and sealed at the ends. The resulting construction is utilized by separating the plastic layers at the open side of the envelope, fitting the envelope over a lumber stack, then folding the ends of the envelope downwardly.

Regardless of which of the foregoing procedures is utilized to wrap a lumber stack in plastic sheeting, it has heretofore been the practice to secure the plastic sheeting to the lumber stack by stapling the plastic sheeting to the lowermost layer of lumber in the stack at spaced apart intervals around the entire periphery of the stack. The use of staples to secure plastic sheeting to a lumber stack is disadvantageous for at least two reasons. First, the staples can severely damage the lumber into which they are inserted. Second, the stapling procedure is time consuming and therefore expensive.

The present invention comprises a method of and apparatus for securing protective plastic sheeting around stacked lumber which overcomes the foregoing and other difficulties which have long since characterized the prior art. In accordance with the broader aspects of the invention, the plastic sheeting that is utilized in the protection of stacked lumber comprises heavy duty shrinkwrap plastic material. The heavy duty shrinkwrap plastic material is positioned around a lumber stack. Thereafter, the portions of the heavy duty shrinkwrap material which are located at the ends of the lumber stack are heated. In this manner, the heavy duty shrinkwrap material is drawn tightly around the lumber stack and is secured thereto without the use of multiple staples.

In accordance with more specific aspects of the invention, a layer of heavy duty shrinkwrap plastic material is closely fitted around a lumber stack. The portions of the heavy duty shrink wrap plastic material which engage the ends of the lumber stack are initially secured in place by as few as two staples. Thereafter, the portions of the heavy duty plastic shrinkwrap material which engage the ends and the corners of the lumber stack are heated, thereby securing the heavy duty plastic shrinkwrap material securely to the lumber stack particularly at the corners. Optionally, the portion of the heavy duty plastic shrinkwrap material which extends across the top of the lumber stack may also be heated resulting in a smooth, upper surface.

In accordance with another aspect of the invention, an appropriately sized sheet of heavy duty plastic shrinkwrap material is folded along spaced apart longitudinally extending lines and is sealed at the ends. The resulting construction is characterized by a solid upper layer and a lower layer having an opening extending longitudinally along the center thereof from one end to the other. The plastic sheeting construction of the present invention is much easier to install around a lumber stack as compared with the envelope of the prior art in which the opening extends along the side edges of spaced apart plastic layers. Additionally, when the plastic sheeting construction of the present invention is installed around a lumber stack, the end portions thereof are formed into a rectangular flap which is easily secured in place by two staples at each end of the lumber stack.

BRIEF DESCRIPTION OF THE DRAWINGS

A more complete understanding of the invention may be had by reference to the following Detailed Description when taken in conjunction with the accompanying Drawings wherein.

DETAILED DESCRIPTION

Figure 1:
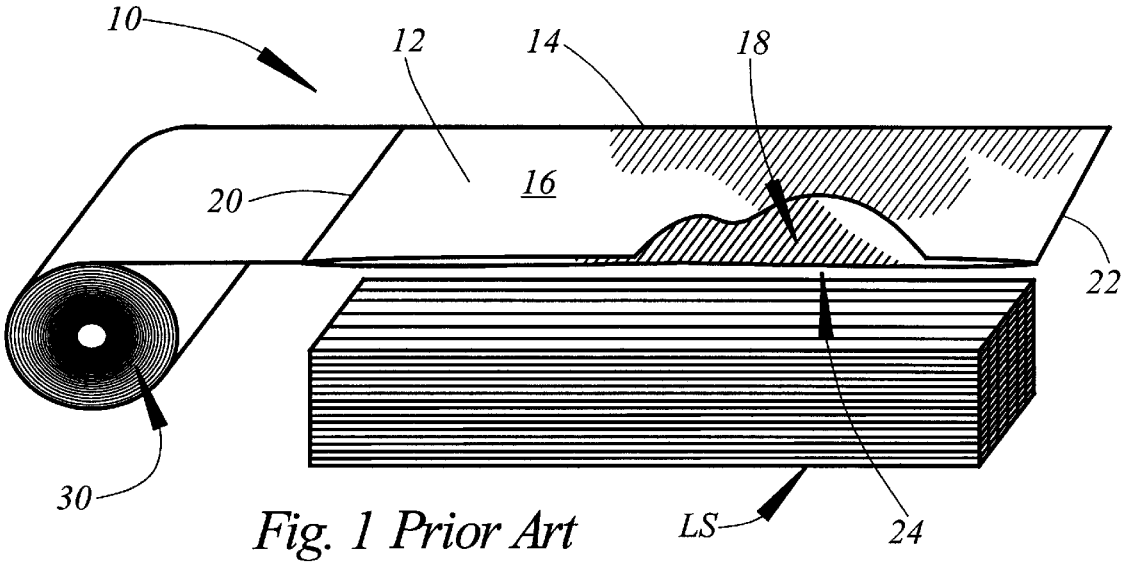
Fig. 1 Prior Art
FIG. 1 is an illustration of a first step in a prior art method of protecting stacked lumber.
Figure 2:
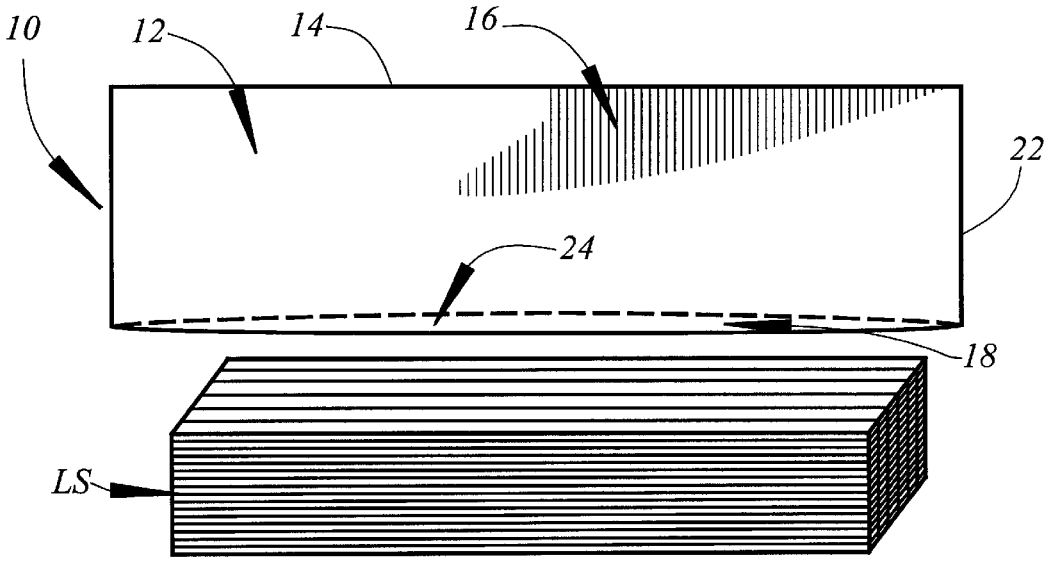
Fig. 2 Prior Art
FIG. 2 is an illustration of a subsequent step in the prior art method of FIG. 1.
Figure 3:
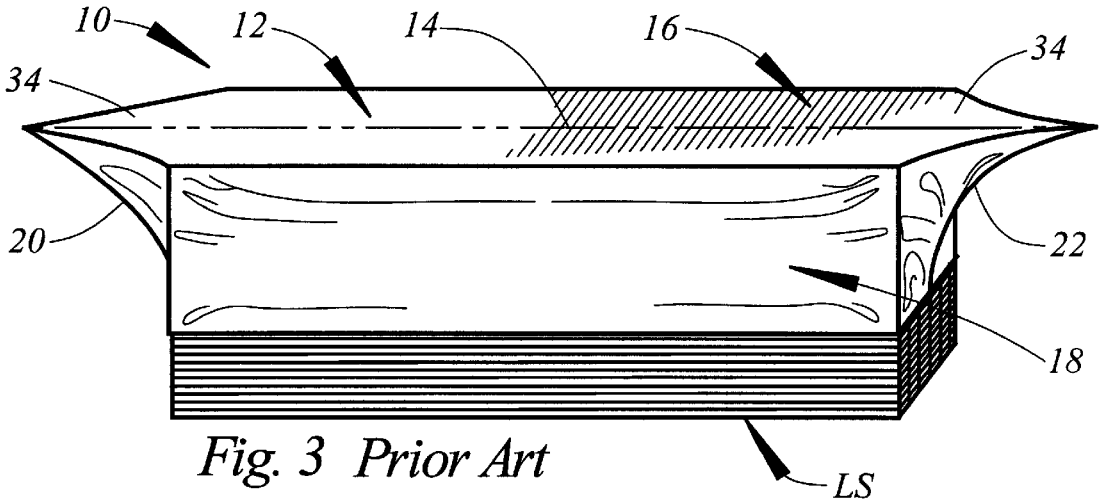
Fig. 3 Prior Art
FIG. 3 is an illustration of a subsequent step in the prior art method of FIGS. 1 and 2.
Figure 4:
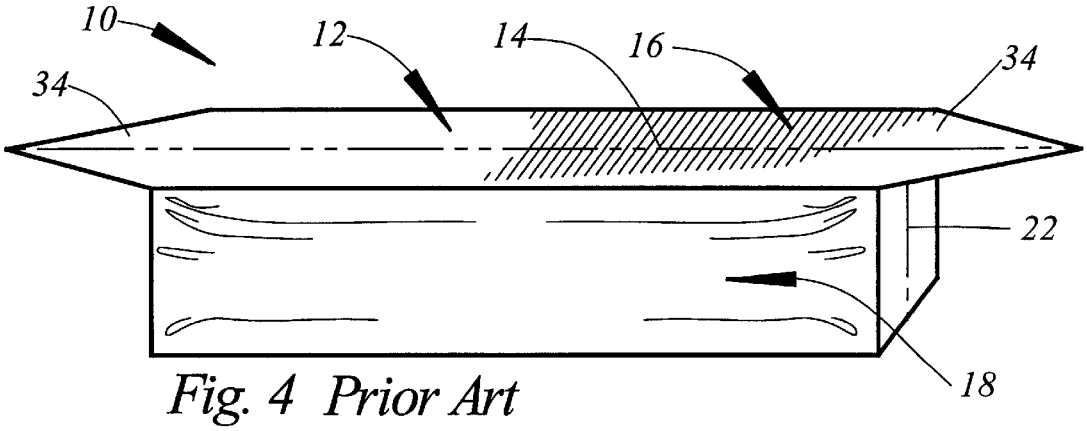
Fig. 4 Prior Art
FIG. 4 is an illustration of a subsequent step in the prior art method of FIGS. 1, 2, and 3.

Referring now to the Drawings, and particularly to FIGS. 1–6 thereof, there is shown a method of enclosing a lumber stack in a layer of plastic sheeting 10 which is characteristic of the prior art. In accordance with the method 10, an appropriately sized layer of plastic sheeting 12 is folded along its longitudinally center line 14 thereby defining an upper layer 16 and a lower layer 18. The ends 20 and 22 of the layers 16 and 18 are joined, typically by heat sealing. In this manner, there is provided an envelope characterized by an opening 24 extending along the edges of the layers 16 and 18 opposite the folds therebetween.

In actual practice, the envelopes of FIGS. 1–6 are manufactured from a continuous tube of plastic material. The tube is slit along one edge thereof. Both ends of each envelope formed from the tube are heat sealed. The tube is also perforated at the ends of each envelope to facilitate the separation of one envelope from the next.

Figure 5:
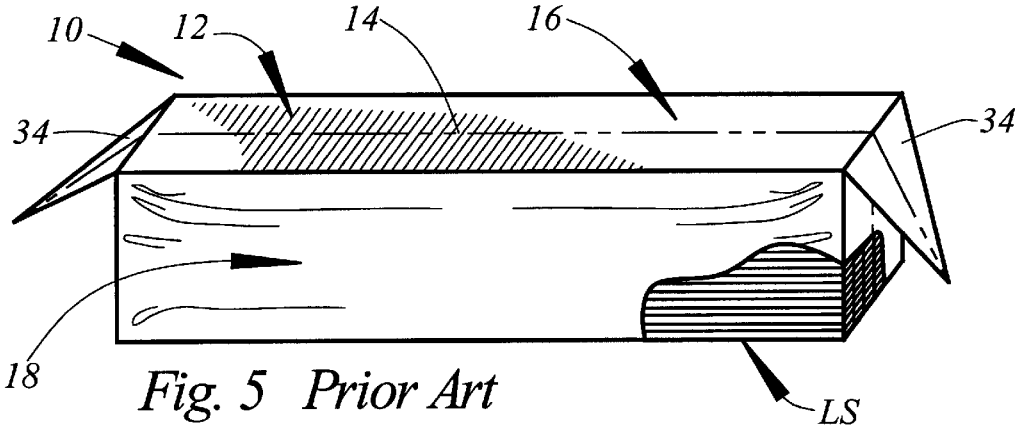
Fig. 5 Prior Art
FIG. 5 is an illustration of a subsequent step in the prior art method of FIGS. 1, 2, 3, and 4.
Figure 6:
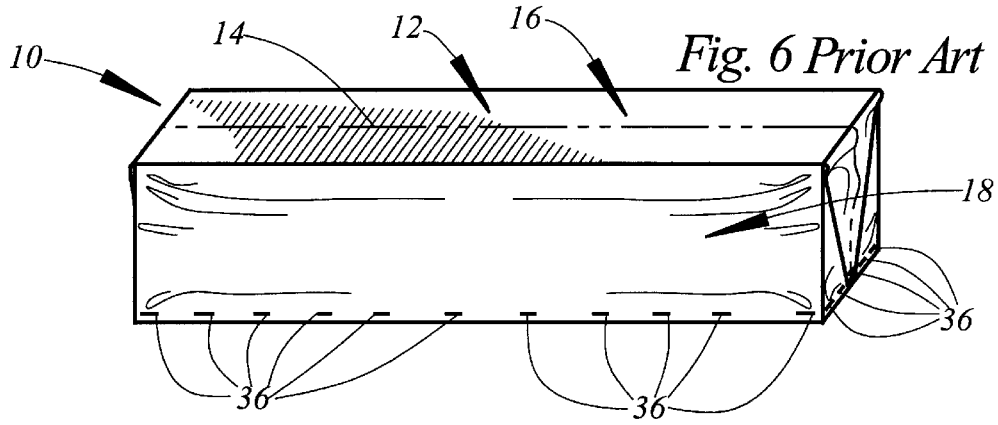
Fig. 6 Prior Art
FIG. 6 is an illustration of the final step in the prior art method of FIGS. 1, 2, 3, 4, and 5.
Figure 7:
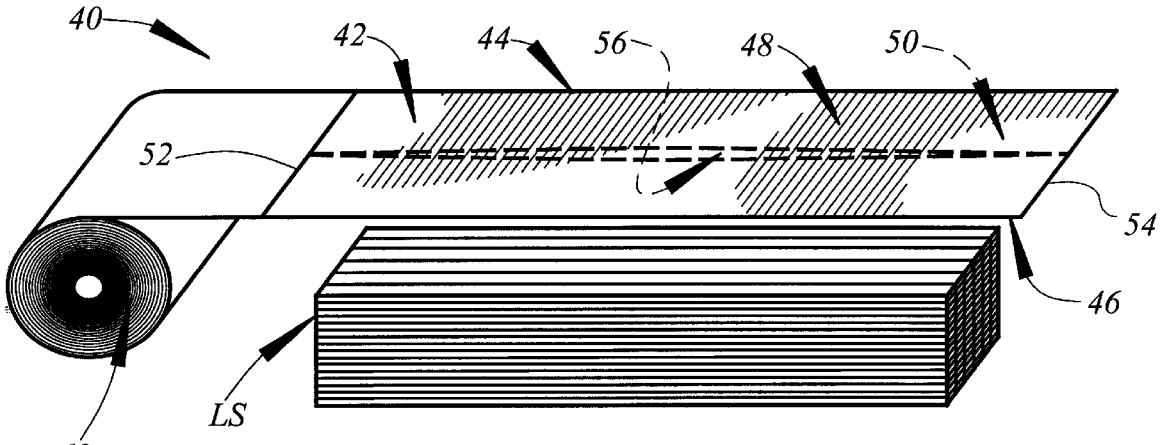
FIG. 7 is an illustration of a first step in the method of protecting stacked lumber comprised in the present invention.
Figure 8:
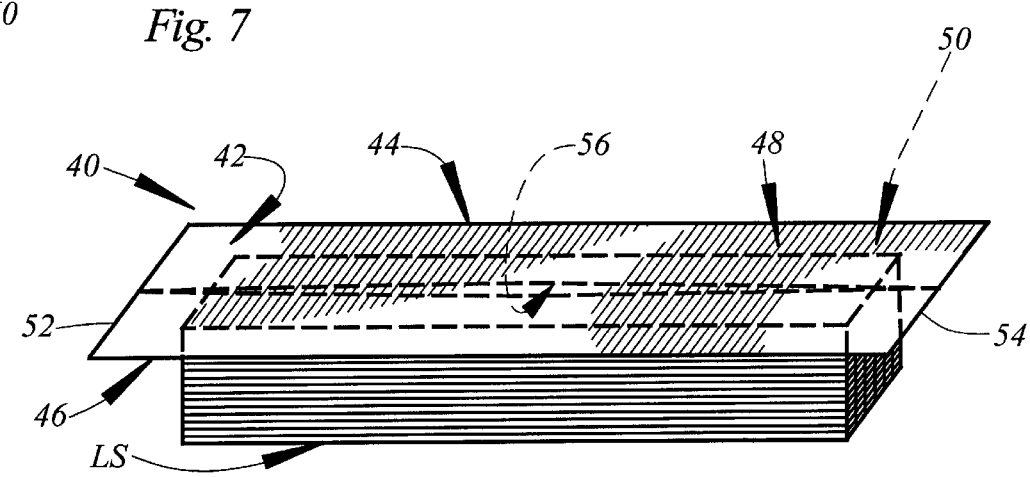
FIG. 8 is an illustration of a subsequent step in the method of FIG. 7.
Figure 9:
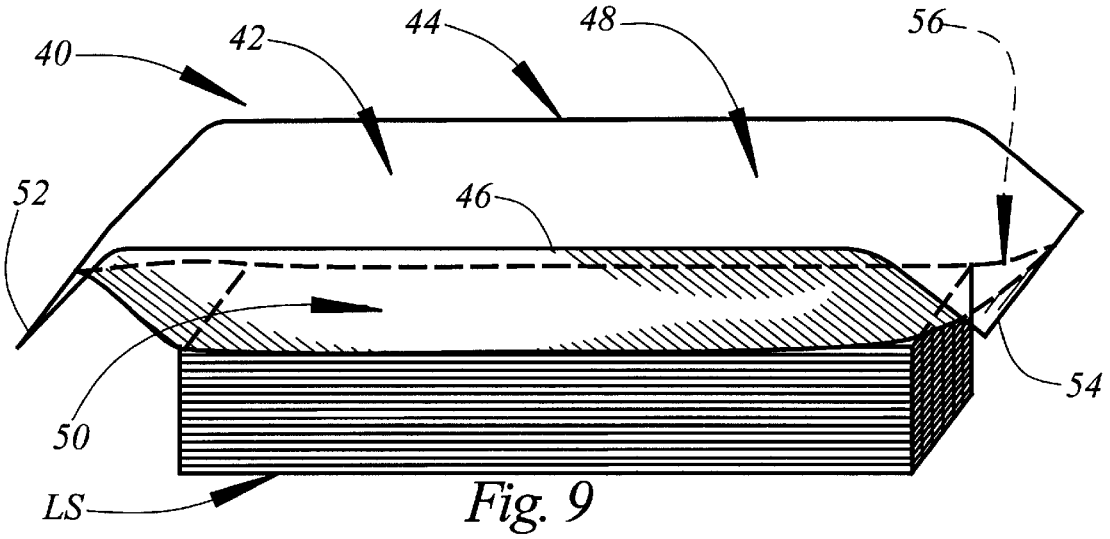
FIG. 9 is an illustration of a subsequent step in the method of FIGS. 7 and 8.
Figure 10:
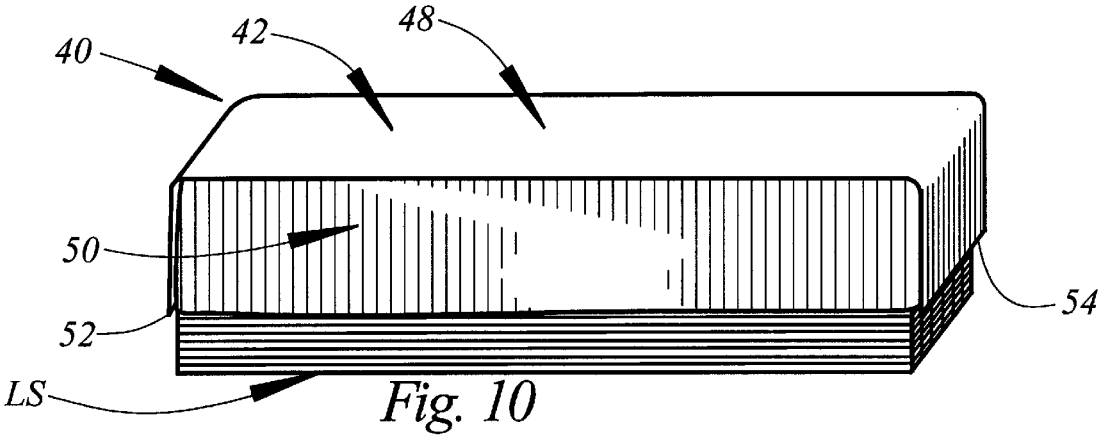
FIG. 10 is an illustration of a subsequent step in the method of FIGS. 7, 8, and 9.
Figure 11:
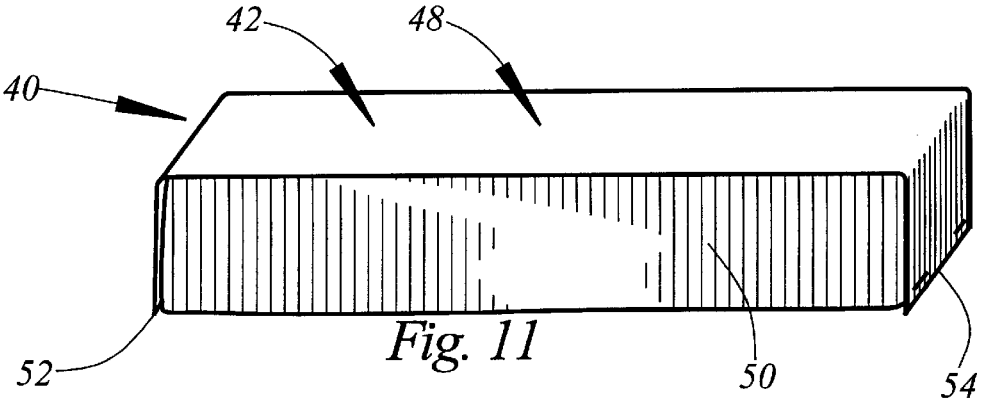
FIG. 11 is an illustration of a subsequent step in the method of FIGS. 7, 8, 9, and 10.

The plastic sheeting envelopes of the prior art are typically provided in rolls 30. When an individual plastic sheeting envelope is removed from a roll 30, it must be manipulated into a vertical orientation to align the opening 24 thereof with a lumber stack LS. The layers 16 and 18 are then separated and extended along the sides of the lumber stack LS. This results in triangular shapes projections 34 extending outwardly at the opposite ends of the lumber stack LS. As is shown in FIGS. 5 and 6, the projections 34 are folded downwardly, after which the plastic sheeting comprising the envelope is secured to the lumber stack LS by multiple staples 36 which are driven into the lumber stack LS at spaced apart intervals extending around the entire periphery thereof.

The use of staples to secure protective plastic sheeting around a lumber stack is disadvantageous for at least two reasons. First, the installation of staples is a time consuming and therefore expensive process. Perhaps more importantly, the outermost components of the lower layer comprising the lumber stack can be and often are ruined by the staples which are used to secure the plastic sheeting into place.

Referring to FIGS. 7–13, there is shown a method of and apparatus for protecting stacked lumber which incorporates the preferred embodiment of the present invention. In accordance with the method 40, a suitably sized sheet of heavy duty plastic shrinkwrap material 42 is folded along spaced apart longitudinally extending lines 44 and 46 to form an upper layer 48 and a lower layer 50. The opposite ends 52 and 54 of the upper and lower layers 48 and 50 are then joined. The joining step is typically carried out by heat sealing, however, various types and kinds of adhesives may be utilized to join the ends of the upper and lower layers 48 and 50 depending upon the requirements of particular applications of the invention.

In actual practice, the envelopes of FIGS. 1–6 are manufactured from a continuous tube of plastic material. The tube is slit along the bottom thereof. Both ends of each envelope formed from the tube are heat sealed. The tube is also perforated at the ends of each envelope to facilitate the separation of one envelope from the next.

The resulting lumber stack protection assembly comprises an upper layer 48 which is entirely solid throughout its length and width. The lower layer is differentiated from the upper layer 48 in that it is entirely solid throughout its length and width except for an opening 56 which extends longitudinally along the center line of the lower layer 50 from the end 52 to the end 54.

The foregoing steps result in a lumber stack protection assembly comprising the present invention. The lumber stack protection assembly may be supplied in rolls 60. When an individual lumber stack protection assembly incorporating the invention is removed from a roll 60, it is easily centered over a lumber stack to be protected with the opening 56 thereof aligned with the center line of the lumber stack LS. The difficulty which has characterized the proper alignment of the opening extending along one side of the envelope of the prior art with the lumber stack to be protected is thereby eliminated.

After the lumber stack protection assembly of the present invention is aligned with a lumber stack to be protected, the opposite sides of the bottom wall 50 thereof are separated and extended along the sides of the lumber stack LS. This results in rectangularly shaped projections 62 which are folded downwardly and secured in place by two staples 64 which are driven into the ends of the lumber stack.

Figure 12:
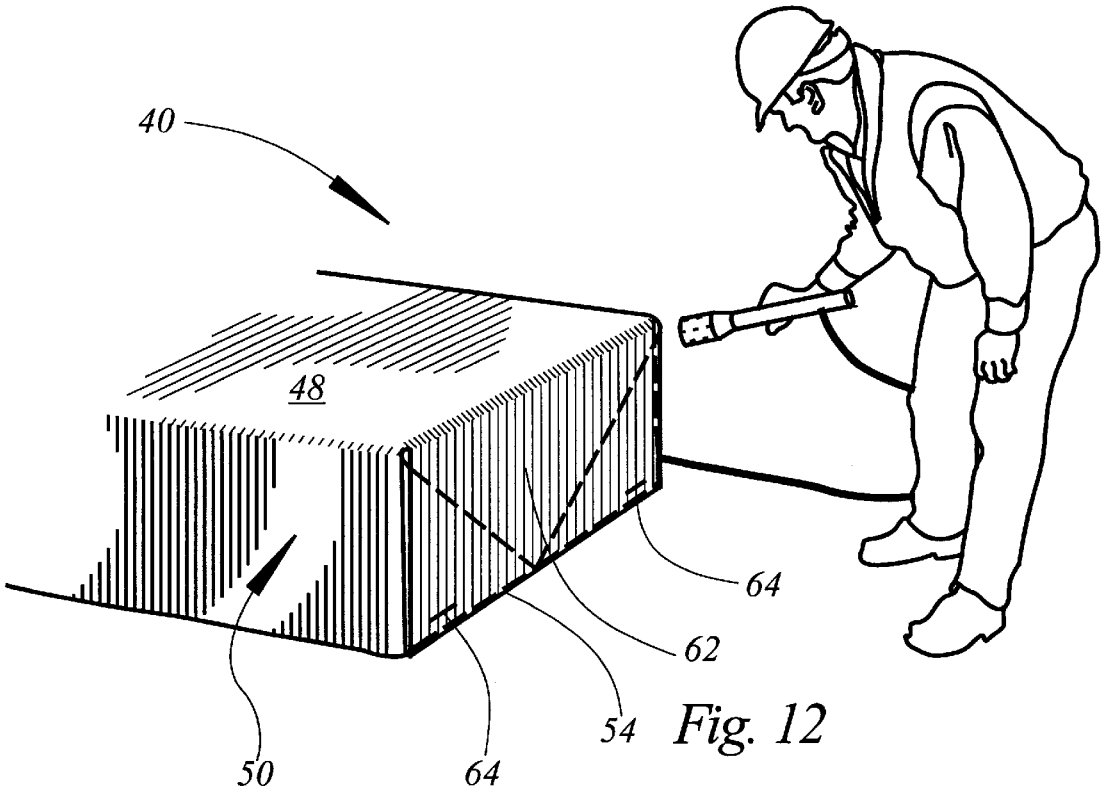
FIG. 12 is an illustration of a final step in the method of FIGS. 7, 8, 9, 10, and 11.
Figure 13:
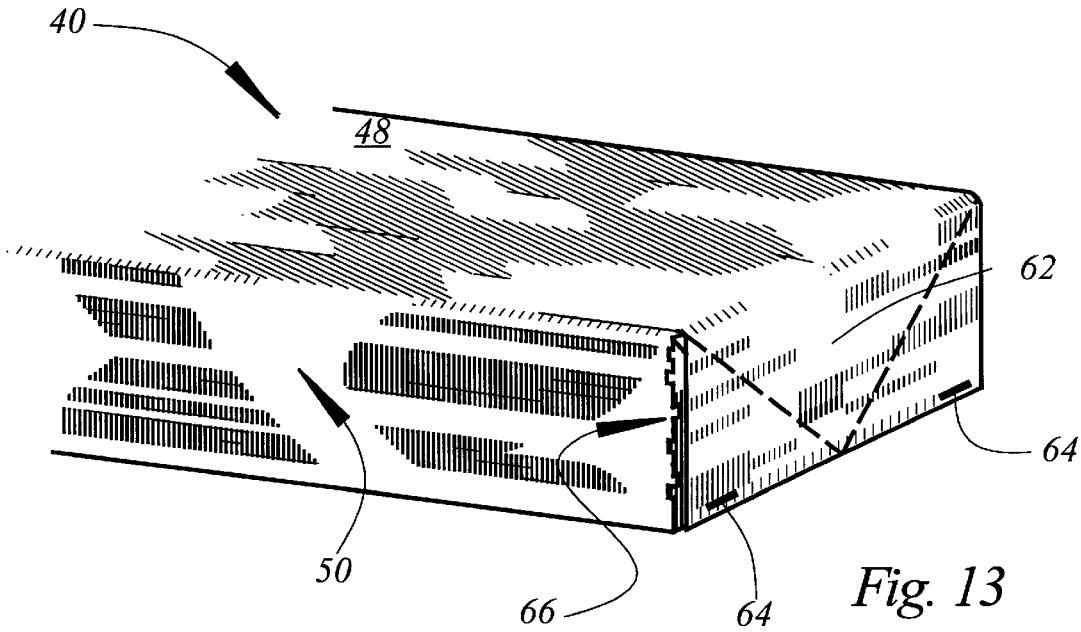
FIG. 13 is an illustration of the result obtained from the method of protecting stacked lumber comprised in the invention.

Referring particularly to FIGS. 12 and 13, the next step in the method of the present invention comprising the application of heat to the portions of the lumber stack protection assembly which are located at the ends and the corners of the lumber stack. In this manner the heavy duty plastic heat shrink material which is utilized in the fabrication of the lumber stack protection assembly is drawn tightly into engagement with the corners of the lumber stack in the manner indicated at 66. In this manner the lumber stack protection assembly is tightly secured to the lumber stack LS without requiring the use of multiple staples driven into the lumber stack at spaced apart intervals around the entire periphery of the lower most layer thereof.

The method of the present invention includes the optional step of applying heat to the portion of the lumber stack protection assembly which extends over the top of the lumber stack. The optional step of heating the top surface of the lumber stack protection assembly results in a covering for the top of the lumber stack which is entirely smooth and wrinkle free. As will be appreciated by those skilled in the art, in many instances lumber stacks are positioned one on top of another for transport in which case the step of heating the portion of the plastic sheeting construction 60 extending over the top of the lumber stack is usually considered unnecessary.

Although preferred embodiments of the invention have been illustrated in the accompanying Drawing and described in the foregoing Detailed Description, it will be understood that the invention is not limited to the embodiments disclosed but is capable of numerous rearrangements, modifications, and substitutions of parts and elements without departing from the spirit of the invention.

What is claimed is:

1. A lumber stack protection assembly for receiving a lumber stack having predetermined length, width, and height dimensions comprising a rectangular sheet of plastic material having side edges defining the width of the sheet and end edges defining the length of the sheet;

said sheet being folded along longitudinally extending lines each located inwardly from an adjacent side edge approximately one quarter of the width of the sheet to define top and bottom walls which are joined one to another along the entire width of the end edges, the top wall being closed across its entire length and width and the bottom wall being closed across its entire length and width except for a slit extending the entire length of the sheet along the longitudinal center line of the bottom wall;

said slit being openable to receive the lumber stack therethrough.

2. The lumber stack protection assembly according to claim 1 wherein the plastic sheeting material comprises a heavy duty heat shrinkable plastic material.

3. The lumber stack protection assembly according to claim 1 wherein the end edges of the top and bottom walls are joined together by heat sealing.

4. The lumber stack protection assembly according to claim 1 wherein the end edges of the top and bottom walls are joined together by an adhesive.

5. The lumber stack protection assembly according to claim 1 wherein the plastic sheeting material comprises a heavy duty heat shrinkable plastic material and wherein the end edges of the top and bottom layers are joined together by heat sealing.

6. A protective covering for a lumber stack comprising:

a plastic sheeting construction comprising a rectangular sheet of plastic material having side edges defining the width of the sheet and end edges defining the length of the sheet and folded along longitudinally extending lines each located inwardly from an adjacent side edge a distance substantially equal to one quarter of the width of the sheet to define top and bottom walls which are joined one to another along the entirety of the end edges, the top wall being solid across its entire length and width and the bottom wall being solid across its entire length and width except for a slit extending the entire length of the sheet along the longitudinal center line of the bottom wall;

a lumber stack received within the plastic sheeting construction through the slit in the bottom wall thereof thereby forming initially outwardly extending triangularly shaped panels which are folded downwardly and secured adjacent the ends of the lumber stack.

7. The plastic sheeting construction according to claim 6 wherein the plastic sheeting material comprises a heavy duty heat shrinkable plastic material.

8. The plastic sheeting construction according to claim 6 wherein the end edges of the top and bottom walls are joined together by heat sealing.

9. The plastic sheeting construction according to claim 6 wherein the end edges of the top and bottom walls are joined together by an adhesive.

10. The plastic sheeting construction according to claim 6 wherein the plastic sheeting material comprises a heavy duty heat shrinkable plastic material and wherein the end edges of the top and bottom layers are joined together by heat sealing.

* * * * *